US012031760B2

(12) United States Patent
Kanda et al.

(10) Patent No.: US 12,031,760 B2
(45) Date of Patent: Jul. 9, 2024

(54) FREEZING DEVICE

(71) Applicant: Mitsubishi Electric Corporation, Tokyo (JP)

(72) Inventors: Masahiro Kanda, Tokyo (JP); Masaaki Kamikawa, Tokyo (JP); Shun Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 349 days.

(21) Appl. No.: 17/603,648

(22) PCT Filed: Jun. 17, 2019

(86) PCT No.: PCT/JP2019/023880

§ 371 (c)(1),
(2) Date: Oct. 14, 2021

(87) PCT Pub. No.: WO2020/255198

PCT Pub. Date: Dec. 24, 2020

(65) Prior Publication Data

US 2022/0235987 A1 Jul. 28, 2022

(51) Int. Cl.
*F25B 49/02* (2006.01)
*F04C 18/16* (2006.01)
(Continued)

(52) U.S. Cl.
CPC ..... *F25B 49/022* (2013.01); *F04C 18/16* (2013.01); *F25B 13/00* (2013.01); *F04C 28/06* (2013.01);
(Continued)

(58) Field of Classification Search
CPC ..... F25B 49/022; F25B 49/02; F25B 13/00; F25B 1/047; F25B 41/20; F25B 2500/27;
(Continued)

(56) References Cited

U.S. PATENT DOCUMENTS 5,009,077 A * 4/1991 Okoshi ..... F25B 41/20 62/174
5,167,491 A 12/1992 Keller, Jr. et al.
(Continued)

FOREIGN PATENT DOCUMENTS

CN 107204730 A 9/2017
EP 3569950 A1 11/2019
(Continued)

OTHER PUBLICATIONS

Extended European Search Report dated Jun. 1, 2022 issued in corresponding European Patent Application No. 19933756.9.
(Continued)

*Primary Examiner* — Emmanuel E Duke
(74) *Attorney, Agent, or Firm* — Posz Law Group, PLC

(57) ABSTRACT

A freezing device including a compressor that compresses sucked refrigerant using a compression mechanism and discharges compressed refrigerant includes a compressor, an inverter, and a controller. The compressor includes a motor, a low pressure unit, a compression space, a high pressure unit, a communication flow path, and a flow control valve. The inverter drives or stops the motor. The controller controls the inverter and the flow control valve. The controller performs, in stop control in which an operation of the compressor is stopped, braking control in which driving of the compression mechanism is prevented or suppressed, and pressure equalization control in which pressure in the high pressure unit is equalized with pressure in the low pressure unit.

11 Claims, 10 Drawing Sheets

(51) Int. Cl.

| | |
|---|---|
| ***F25B 13/00*** | (2006.01) |
| *F04C 28/06* | (2006.01) |
| *F25B 1/047* | (2006.01) |
| *F25B 41/20* | (2021.01) |

(52) U.S. Cl.
CPC ..... *F25B 1/047* (2013.01); *F25B 41/20* (2021.01); *F25B 2500/27* (2013.01); *F25B 2600/021* (2013.01); *F25B 2600/15* (2013.01); *F25B 2700/21152* (2013.01)

(58) Field of Classification Search
CPC ..... F25B 2600/021; F25B 2600/15; F25B 2600/02; F25B 2700/21152; F04C 18/16; F04C 18/52; F04C 28/06; F04C 28/24; F04C 2270/095
See application file for complete search history.

(56) References Cited

U.S. PATENT DOCUMENTS

| | | | |
|---|---|---|---|
| 6,042,344 | A | 3/2000 | Lifson |
| 2012/0183418 | A1 | 7/2012 | Matsumoto et al. |

FOREIGN PATENT DOCUMENTS

| | | | | | |
|---|---|---|---|---|---|
| JP | S55-028762 | U | | 2/1980 | |
| JP | H05-223361 | A | | 8/1993 | |
| JP | H07-167076 | A | | 7/1995 | |
| JP | 2000-287485 | A | | 10/2000 | |
| JP | 2000287485 | A | * | 10/2000 | |
| JP | 2008-180462 | A | | 8/2008 | |
| JP | 2008-298006 | A | | 12/2008 | |
| JP | 2011-094611 | A | | 5/2011 | |
| JP | 4767188 | B2 | | 9/2011 | |
| JP | 2014-145334 | A | | 8/2014 | |
| JP | 2016-020651 | A | | 2/2016 | |
| WO | 2018/131089 | A1 | | 7/2018 | |
| WO | WO-2019124409 | A1 | * | 6/2019 | ..... C09K 5/04 |

OTHER PUBLICATIONS

International Search Report dated Aug. 6, 2019, issued in corresponding International Patent Application No. PCT/JP2019/023880 (and English Machine Translation).

* cited by examiner

| | | | | |
|---|---|---|---|---|
| ROTATION BRAKING CONTROL | OFF | ON | OFF | |
| FLOW CONTROL VALVE | OFF | ON | | OFF |

FREEZING DEVICE

CROSS REFERENCE TO RELATED APPLICATION

This application is a U.S. National Stage Application of International Application No. PCT/JP2019/023880, filed on Jun. 17, 2019, the contents of which are incorporated herein by reference.

TECHNICAL FIELD

The present disclosure relates to a freezing device including a screw compressor.

BACKGROUND ART

Hitherto, a screw compressor has been known as a positive displacement compressor. A screw compressor is, for example, used as a component of a refrigerant circuit included in a freezing device or the like. As a screw compressor, for example, a single screw compressor including one screw rotor and one or two gate rotors is known, the one screw rotor having helical screw channels, the one or two gate rotors having a plurality of gate rotor tooth units that engage with the screw channels.

In the single screw compressor, the screw channels and the gate rotor tooth units engage with each other, and a plurality of compression spaces are formed as a result of engagement of the screw channels with the gate rotor tooth units. One end of the screw rotor in a rotation axis direction corresponds to a refrigerant suction side, and the other end of the screw rotor in the rotation axis direction corresponds to a refrigerant discharge side. The inside of a casing where the screw rotor and the gate rotor(s) are housed is partitioned into a low pressure unit provided on the suction side of the compression space and a high pressure unit provided on the discharge side of the compression space.

In the single screw compressor, as the screw rotor rotates, the gate rotor tooth units move across the screw channels, and an operation for increasing the capacity of each compression space and an operation for reducing the capacity of the compression space are repeated. In a period when the capacity of the compression space increases, refrigerant is sucked into the compression space, and in a period when the capacity of the compression space decreases, sucked refrigerant is compressed. When a screw channel constituting the compression space communicates with a discharge port, the compressed high-pressure refrigerant is discharged from the compression space via the discharge port.

In a case where the single screw compressor is in operation, the screw rotor rotates while a suction-side side surface of a pair of side surfaces of the gate rotor tooth units facing each other in the circumferential direction of the gate rotor tooth units is kept in contact with a wall unit of the screw channel, the suction-side side surface being positioned on the suction side in a state where the gate rotor tooth unit engages with the screw channel. In contrast, in a case where the single screw compressor stops, the screw rotor counter-rotates due to the difference in pressure of refrigerant. When the screw rotor counter-rotates, the screw rotor rotates while a discharge-side side surface of the pair of side surfaces of the gate rotor tooth units is kept in contact with the wall unit of the screw channel. Due to this counter rotation, the gate rotor may be damaged or worn away.

In Patent Literature 1, a technology for suppressing counter rotation of a screw rotor caused in a case where a single screw compressor stops is disclosed. In the single screw compressor described in Patent Literature 1, rotation braking control is performed in which a direct-current voltage is applied from an inverter to a motor stator in the compressor to perform control such that the motor rotor does not rotate.

CITATION LIST

Patent Literature

Patent Literature 1: Japanese Unexamined Patent Application Publication No. 2000-287485

SUMMARY OF INVENTION

Technical Problem

When the rotation braking control described in Patent Literature 1 is performed, refrigerant flows from a high pressure unit into a low pressure unit, and the pressure in the high pressure unit and the pressure in the low pressure unit are equalized with each other. In this case, refrigerant flows through a small flow path such as a minute gap between the screw rotor and the casing and a small oil feed hole through which oil is fed into the compression space using a differential pressure oil feed method for, for example, the purpose of bearing lubrication. Thus, a long time period is needed to equalize the pressure in the high pressure unit and the pressure in low pressure unit with each other.

Until the pressure in the high pressure unit and the pressure in the low pressure unit are equalized with each other, oil feeding from the high pressure unit into the compression space continues. Thus, oil flows out from the compression space to the low pressure unit, and when the compressor is started up next time, a large amount of oil may be sucked into the compression space, liquid compression (oil compression) may occur, and the gate rotor may fail.

Moreover, for an inverter having a limited braking control time period, in a case where the pressure in the high pressure unit and the pressure in the low pressure unit cannot be equalized with each other within the limited braking control time period, the screw rotor counter-rotates when the braking control ends, and the gate rotor may be damaged or worn away.

The present disclosure has been made in light of the problems in the related-art technology described above, and an object of the present disclosure is to provide a freezing device that suppresses driving of a compression mechanism when braking control ends and that can suppress damage to or wearing away of the compression mechanism.

Solution to Problem

A freezing device according to an embodiment of the present disclosure is a freezing device including a compressor that compresses sucked refrigerant using a compression mechanism and discharges compressed refrigerant. The freezing device includes a compressor including a motor that drives the compression mechanism, a low pressure unit in which the sucked refrigerant flows, a compression space in which the refrigerant flowing in the low pressure unit is compressed, a high pressure unit in which the refrigerant compressed in the compression space flows, a communication flow path through which the low pressure unit and the high pressure unit communicate, and a flow control valve that is provided in the communication flow path and that controls a flow rate of the refrigerant flowing through the communication flow path, an inverter that supplies a voltage to the compressor and drives or stops the motor, and a controller that controls the inverter and the flow control valve. The controller performs, in stop control in which an operation of the compressor is stopped, braking control in which driving of the compression mechanism is prevented or suppressed by controlling the inverter, and pressure equalization control in which pressure in the high pressure unit is equalized with pressure in the low pressure unit by opening the flow control valve.

Advantageous Effects of Invention

According to an embodiment of the present disclosure, when the operation of the compressor stops, the braking control is performed, and the pressure equalization control is also performed. As a result, a time period needed to equalize the pressure in the high pressure unit with the pressure in the low pressure unit is reduced, and thus driving of the compression mechanism can be suppressed when the braking control ends, and damage to or wearing away of the compression mechanism can be suppressed.

DESCRIPTION OF EMBODIMENTS

Embodiment 1

Figure 1A:
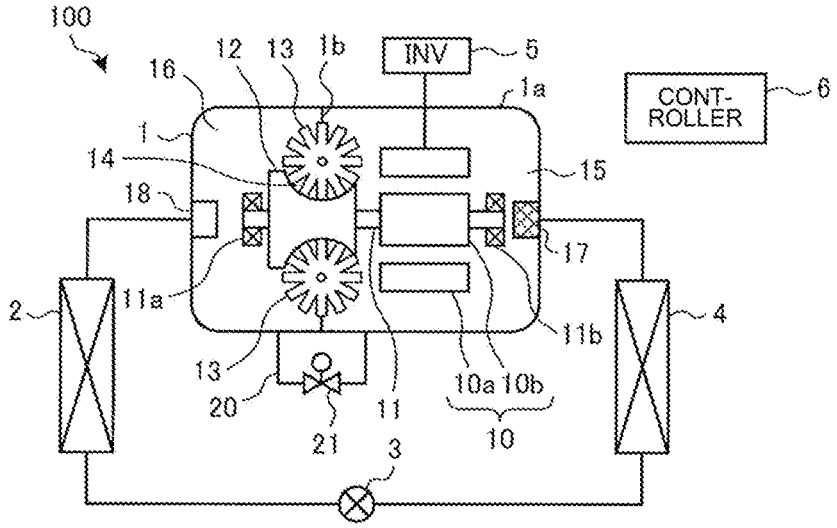
FIG. 1A is a circuit diagram illustrating an example of the configuration of a freezing device according to Embodiment 1.

In the following, a freezing device according to Embodiment 1 will be described. In the following drawings, items denoted by the same reference numeral are identical or substantially identical to each other, and this applies to the entirety of the specification. Forms of the constituent elements illustrated in the entirety of the specification are mere examples, and the forms are limited to those described in the specification. In particular, combinations of the components are not limited to combinations in the individual embodiments, and a component described in another embodiment may be applied to another embodiment. Moreover, high and low in, for example, pressure are not specifically determined in relation to certain absolute values and are determined relatively to, for example, the state or operation of a system, a device, and the like. Furthermore, the relationship between sizes of individual components may differ from an actual relationship in the drawings.

[Configuration of Freezing Device 100]

FIG. 1A is a circuit diagram illustrating an example of the configuration of a freezing device 100 according to Embodiment 1. As illustrated in FIG. 1A, the freezing device 100 includes a compressor 1, a condenser 2, a pressure reducing device 3, an evaporator 4, an inverter 5, and a controller 6. In the freezing device 100, the compressor 1, the condenser 2, the pressure reducing device 3, and the evaporator 4 are connected in this order by refrigerant pipes to form a refrigerant circuit in which refrigerant circulates.

Refrigerant circulating through the refrigerant circuit is not particularly limited. For example, a fluorocarbon refrigerant such as a hydrofluorocarbon (HFC) and a hydrofluoroolefin (HFO), a hydrocarbon refrigerant such as a hydrocarbon (HC), or a natural refrigerant such as carbon dioxide ($CO_2$) and ammonia can be applied regardless of the magnitude of operation pressure.

(Compressor 1)

The compressor 1 sucks low-temperature and low-pressure refrigerant and discharges high-temperature and high-pressure refrigerant by compressing the sucked refrigerant. The compressor 1 is formed by, for example, an inverter compressor whose capacity, namely, output amount per unit time is controlled by, for example, changing operation frequency. The operation frequency of the compressor 1 is controlled by the controller 6.

The compressor 1 is driven by supplying power to a motor 10, which is to be described later, from a power supply source (not illustrated) via the inverter 5. The compressor 1 has a rotation braking control function through which the rotation of the motor 10 is controlled, the rotation braking control function being executed when stop control is performed to stop operation. Specifically, the rotation braking control function is a function through which the rotation of the motor 10 is controlled to prevent or suppress the rotation of a motor rotor 10*b* even when a force that tries to rotate the motor rotor 10*b* is received due to torque produced by the motor 10 through application of a direct-current voltage to a stator 10*a*, which is to be described later, from the inverter 5.

As the compressor 1 according to Embodiment 1, for example, a single screw compressor is used in which one screw rotor is engaged with two gate rotors. FIG. 1A illustrates such a single screw compressor.

The compressor 1 includes a tubular casing 1*a* and the motor 10, a screw shaft 11, a screw rotor 12, and gate rotors 13, and so forth, which are housed in the casing 1*a*. The motor 10 is an inverter motor whose rotation speed is controlled by the inverter 5 and drives the screw rotor 12 to rotate. The motor 10 includes the stator 10*a*, which is inscribed in and fixed to the casing 1*a*, and the motor rotor 10*b*, which is arranged inside the stator 10*a*.

The screw rotor 12 and the motor rotor 10*b* are arranged on the same axis and are each fixed to the screw shaft 11. The screw shaft 11 is fixed to the motor rotor 10*b* and driven to rotate by the motor 10. Both ends of the screw shaft 11 are supported by a main bearing 11*a* and a sub-bearing 11*b*.

One end of the screw rotor 12 corresponds to a refrigerant suction side, and the other end of the screw rotor 12 corresponds to a refrigerant discharge side.

The screw rotor 12 is formed to have a columnar shape, and a plurality of helical screw channels 12*a* are formed in a peripheral surface of the screw rotor 12 (see FIG. 5 to be described later). The screw rotor 12 is coupled to the motor rotor 10*b* fixed to the screw shaft 11 and is driven to rotate.

On the side surfaces of the screw rotor 12, a pair of gate rotors 13 are arranged in an axisymmetric manner with respect to the screw shaft 11. Each gate rotor 13 is formed to have a disc shape and has, on the peripheral surface of the gate rotor 13, a plurality of radially extending teeth 13*a* provided along a circumferential direction of the gate rotor 13 (see FIG. 5). The gate rotor 13 is arranged such that the teeth 13*a* engage with the screw channels 12*a* of the screw rotor 12. Spaces surrounded by the teeth 13*a* of the gate rotors 13, the screw channels 12*a*, and an inner tube surface of the casing 1*a* form compression spaces 14. Note that, in the following description, a configuration including the screw rotor 12, the gate rotors 13, and the compression spaces 14, which are formed by the screw rotor 12 and the gate rotors 13, may also be collectively referred to as "compression mechanism".

The inside of the casing 1*a* is partitioned by a partition wall 1*b* into a low pressure unit 15 corresponding to a refrigerant suction side where low pressure refrigerant is positioned and a high pressure unit 16 including the compression spaces 14 and corresponding to a refrigerant discharge side where high pressure refrigerant is positioned. The low pressure unit 15 has a suction port that is formed, that is open to a flow path on the refrigerant suction side, and that is not illustrated. A strainer 17 is arranged in the suction port to prevent foreign substances such as dust from flowing into the compressor 1.

The high pressure unit 16 has a discharge port 1*c* (see FIG. 5) that is formed and that is open to a flow path on the refrigerant discharge side. A check valve 18 is provided in the discharge port 1*c* to prevent discharged refrigerant from flowing backward. Note that the check valve 18 may be externally provided in the compressor 1 or the check valve 18 does not have to be provided.

In the high pressure unit 16, high pressure refrigerant gas and refrigerating machine oil discharged from the compression spaces 14 are present, and an oil separator for separating the refrigerant gas from the refrigerating machine oil, which are discharged from the compression spaces 14, and an oil reservoir that stores separated refrigerating machine oil are arranged although both the oil separator and the oil reservoir are not illustrated. Furthermore, an oil flow path for supplying refrigerating machine oil from the oil reservoir to the compression spaces 14 is provided in the compressor 1. Refrigerating machine oil flows through this oil flow path and is supplied to the compression spaces 14 by pressure difference from an oil feed hole provided in the casing 1*a*. In contrast, refrigerant gas separated by the oil separator passes through the check valve 18 in the compressor 1 and is thereafter discharged to the refrigerant circuit, which is outside the compressor 1.

In Embodiment 1, the compressor 1 is provided with a communication flow path 20 through which the low pressure unit 15 communicates with the high pressure unit 16. For fluid in the high pressure unit 16, the communication flow path 20 is a bypass to the low pressure unit 15. The communication flow path 20 is provided with a flow control valve 21 for controlling the flow rate of fluid flowing along the communication flow path 20. The opening degree of the flow control valve 21 is controlled by the controller 6. Note that the way in which the communication flow path 20 is formed is not limited. The communication flow path 20 may be formed outside the compressor 1 or may be formed inside the casing 1*a* of the compressor 1 using, for example, a copper pipe or a steep pipe.

Figure 1B:
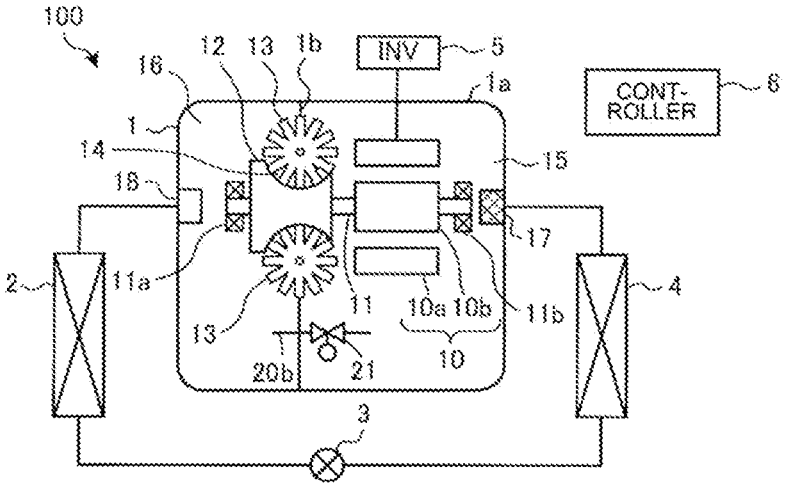
FIG. 1B is a circuit diagram illustrating an example of the configuration of a freezing device according to an alternate embodiment.

FIG. 1B is a circuit diagram illustrating an example of the configuration of a freezing device according to an alternate embodiment. This alternate embodiment is similar to Embodiment 1 and like elements operate in a similar manner. In this alternate embodiment, the compressor 1 is provided with a communication flow path 20*b* through which the low pressure unit 15 communicates with the high pressure unit 16. For fluid in the high pressure unit 16, the communication flow path 20 is a bypass to the low pressure unit 15. The communication flow path 20*b* is provided with a flow control valve 21 for controlling the flow rate of fluid flowing along the communication flow path 20*b*. The opening degree of the flow control valve 21 is controlled by the controller 6. The communication flow path 20*b* in this alternate embodiment is formed inside the casing 1*a* of the compressor 1 using, for example, a copper pipe or a steep pipe.

(Condenser 2)

The condenser 2 exchanges heat between outdoor air supplied by a fan, which is not illustrated, and refrigerant. The condenser 2 transfers heat of refrigerant to outdoor air and condenses refrigerant gas discharged from the compressor 1.

(Pressure Reducing Device 3)

The pressure reducing device 3 reduces the pressure of liquid refrigerant that has flowed out from the condenser 2 to expand. The pressure reducing device 3 includes, for example, a valve whose opening degree can be controlled such as an electronic expansion valve. In this case, the opening degree of the pressure reducing device 3 is controlled by the controller 6. Note that the pressure reducing device 3 is not limited to a valve whose opening degree can be controlled and may also be, for example, a capillary tube.

(Evaporator 4)

The evaporator 4 exchanges heat between air supplied by a fan, which is not illustrated, and refrigerant. The evaporator 4 evaporates refrigerant that has flowed out from the pressure reducing device 3.

(Inverter 5)

The inverter 5 includes, for example, a plurality of switching elements, which are not illustrated, and converts a direct-current voltage into an alternating-current voltage. The motor 10 of the compressor 1 is connected to the inverter 5, and the inverter 5 supplies the resulting alternating-current voltage to the compressor 1. The inverter 5 outputs an alternating-current voltage, which is a pulse width modulation (PWM) voltage, by being controlled by the controller 6.

(Controller 6)

The controller 6 controls the entire freezing device 100 including the compressor 1, the pressure reducing device 3, and the inverter 5. In particular, in Embodiment 1, when stopping the operation of the compressor 1, the controller 6 controls the compressor 1 and the inverter 5 to perform rotation braking control, through which counter rotation of the screw rotor 12 is prevented or suppressed. The controller 6 controls the opening degree of the flow control valve 21 to cause refrigerant in the high pressure unit 16 to flow into the low pressure unit 15 through the communication flow path 20 and performs pressure equalization control through which the pressure difference between the high pressure unit 16 and the low pressure unit 15 is equalized.

Figure 2:
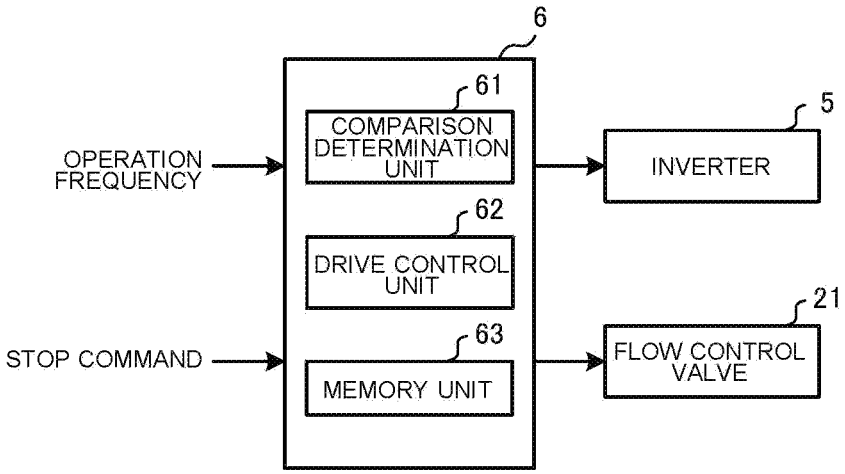
FIG. 2 is a functional block diagram illustrating an example of the configuration of a controller in FIG. 1A.

FIG. 2 is a functional block diagram illustrating an example of the configuration of the controller 6 in FIG. 1A. As illustrated in FIG. 2, the controller 6 includes a comparison determination unit 61, a drive control unit 62, and a memory unit 63. The controller 6 realizes various functions by executing software programs on an arithmetic unit such as a microcomputer or is formed by, for example, a hardware device such as circuit devices that realize the various functions. Note that FIG. 2 only illustrates a configuration corresponding to functions related to Embodiment 1, and illustration of the other configuration is omitted.

The comparison determination unit 61 performs various types of comparisons and determinations. For example, in Embodiment 1, the comparison determination unit 61 determines whether the operation frequency of the compressor 1 has reached a preset operation frequency. Moreover, the comparison determination unit 61 determines whether a set rotation braking time period has elapsed from the start of the rotation braking control. Furthermore, the comparison determination unit 61 determines whether a set pressure equalization time period has elapsed from the start of the pressure equalization control.

The drive control unit 62 controls the inverter 5 and the flow control valve 21 on the basis of a determination result from the comparison determination unit 61.

The memory unit 63 stores, in advance, various types of information to be used by individual units of the controller 6. In Embodiment 1, the memory unit 63 stores the set rotation braking time period and the set pressure equalization time period to be used by the comparison determination unit 61. The set rotation braking time period is a rotation braking control time period from when rotation braking control is started to when the rotation braking control ends. The set pressure equalization time period is a pressure equalization control time period from when pressure equalization control is started to when the pressure equalization control ends.

Figure 3:
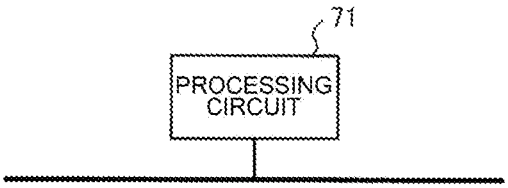
FIG. 3 is a hardware configuration diagram illustrating an example of the configuration of the controller in FIG. 2.

FIG. 3 is a hardware configuration diagram illustrating an example of the configuration of the controller 6 in FIG. 2. In a case where the various functions of the controller 6 are executed by hardware, the controller 6 in FIG. 2 is constituted by a processing circuit 71 as illustrated in FIG. 3. In the controller 6 in FIG. 2, the individual functions of the comparison determination unit 61, the drive control unit 62, and the memory unit 63 are realized by the processing circuit 71.

In a case where the individual functions are executed by hardware, the processing circuit 71 may correspond to, for example, a single circuit, a composite circuit, a programmed processor, a parallel-programmed processor, an application specific integrated circuit (ASIC), a field-programmable gate array (FPGA), or a combination of some or all of these items. In the controller 6, the individual functions of the comparison determination unit 61, the drive control unit 62, and the memory unit 63 may be realized by respective processing circuits 71 or may also be realized by one processing circuit 71.

Figure 4:
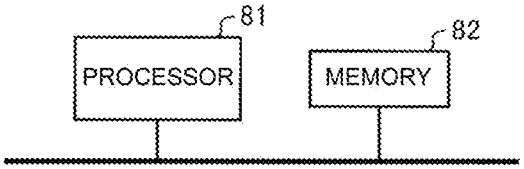
FIG. 4 is a hardware configuration diagram illustrating another example of the configuration of the controller in FIG. 2.

FIG. 4 is a hardware configuration diagram illustrating another example of the configuration of the controller 6 in FIG. 2. In a case where the various functions of the controller 6 are executed by software, the controller 6 in FIG. 2 is formed by a processor 81 and a memory 82 as illustrated in FIG. 4. In the controller 6, the individual functions of the comparison determination unit 61, the drive control unit 62, and the memory unit 63 are realized by the processor 81 and the memory 82.

In a case where the individual functions are executed by software, in the controller 6, the functions of the comparison determination unit 61, the drive control unit 62, and the memory unit 63 are realized by software, firmware, or a combination of software and firmware. The software and the firmware are described as programs and are stored in the memory 82. The processor 81 realizes the functions of the individual units by reading out and executing the programs stored in the memory 82.

As the memory 82, for example, a nonvolatile or volatile semiconductor memory is used. Examples of the nonvolatile or volatile semiconductor memory include a random access memory (RAM), a read only memory (ROM), a flash memory, an erasable and programmable ROM (EPROM), and an electrically erasable and programmable ROM (EEPROM). As the memory 82, for example, a removable recording medium may be used. Examples of the removable recording medium include a magnetic disk, a flexible disk, an optical disc, a compact disc (CD), a mini disc (MD), and a digital versatile disc (DVD).

[Operation of Compressor 1]

Next, the operation of the compressor 1 according to Embodiment 1 will be described. FIG. 5 is a schematic diagram illustrating the principles of compression performed by the compressor 1 according to Embodiment 1. FIG. 5 illustrates "suction process", "compression process", and "discharge process" in this order from the left side of the sheet.

Figure 5:
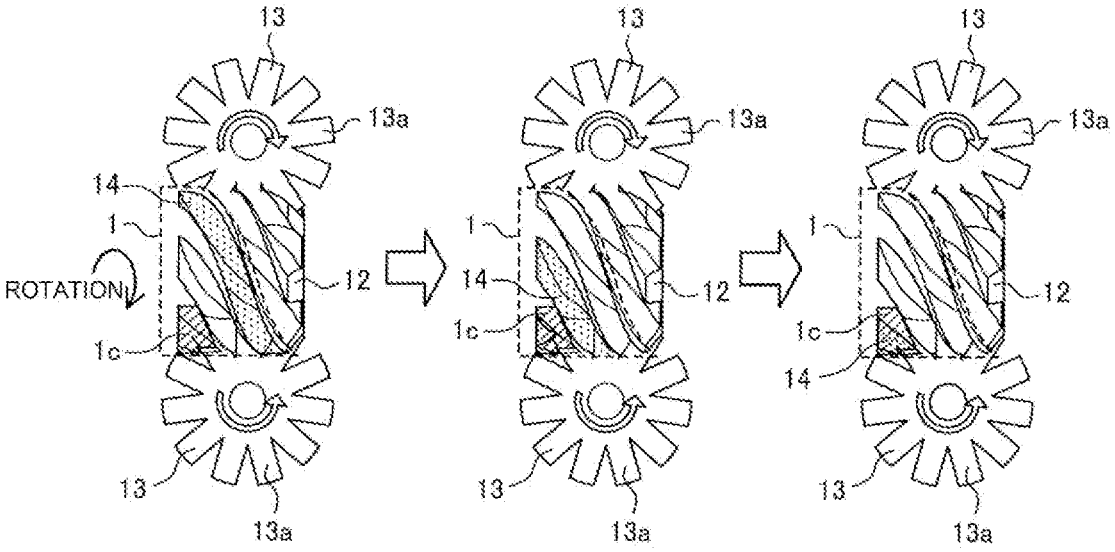
FIG. 5 is a schematic diagram illustrating the principles of compression performed by a compressor according to Embodiment 1.

As illustrated in FIG. 5, in the compressor 1, when the motor 10 is started by the inverter 5, the screw rotor 12 rotates in the direction indicated by a solid line arrow as the screw shaft 11 rotates (see FIG. 1A). In this case, the screw channels 12*a* of the screw rotor 12 engage with the teeth 13*a* of the gate rotors 13. Thus, when the screw rotor 12 rotates, the teeth 13*a* of the gate rotors 13 move in and relative to the screw channels 12*a*, and each gate rotor 13 rotates in the direction indicated by a narrow empty arrow. As a result, a cycle formed by the suction process, the compression process, and the discharge process is repeated in the compression spaces 14. In the following, each process will be described while focusing on a compression space 14 hatched with dots in FIG. 5.

The left diagram in FIG. 5 illustrates the state of the compression space 14 in the suction process. When the screw rotor 12 is driven by the motor 10 to rotate in the direction indicated by the solid line arrow, the teeth 13*a* of the gate rotor 13 rotates in synchronization with this rotation to move sequentially toward the discharge port. As a result, as illustrated in the middle diagram in FIG. 5, the capacity of the compression space 14 is reduced, and refrigerant gas in the compression space 14 is compressed.

When the screw rotor 12 rotates subsequently, the compression space 14 communicates with the discharge port 1*c* as illustrated in the right diagram in FIG. 5. As a result, high pressure refrigerant gas compressed in the compression space 14 is discharged from the discharge port 1*c* to the high pressure unit 16. Substantially the same compression is performed again at the back side of the screw rotor 12.

Note that the compression spaces 14 formed by, for example, the casing 1*a*, the teeth 13*a* of the gate rotors 13, and the screw rotor 12 are provided with minute spaces, which are not illustrated, for allowing the gate rotors 13 and the screw rotor 12 to rotate. These minute spaces serve as a flow path through which high pressure refrigerant gas compressed in the compression spaces 14 and refrigerating machine oil supplied into the compression spaces 14 leak into the low pressure unit 15.

[Rotation Braking Control and Pressure Equalization Control]

Next, rotation braking control performed by the controller 6 will be described. In Embodiment 1, when the operation of the compressor 1 is stopped, rotation braking control is performed to control rotation of the motor 10 such that counter rotation of the screw rotor 12 is prevented or suppressed. In Embodiment 1, in this case, pressure equalization control is performed to cause refrigerant in the high pressure unit 16 to flow into the low pressure unit 15 through the communication flow path 20. In the following, the rotation braking control and the pressure equalization control will be described with reference to a specific example illustrated in FIG. 6.

Figure 6:
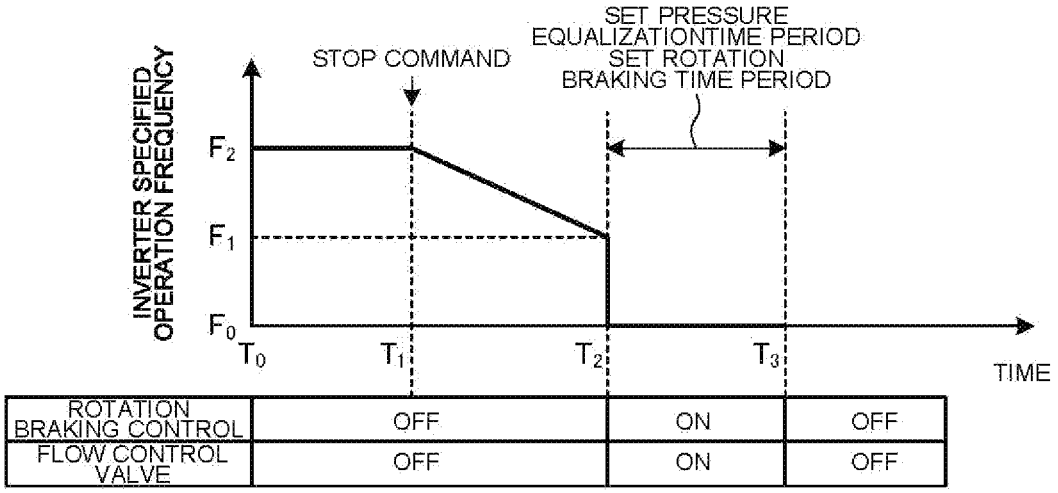
FIG. 6 is a schematic diagram for describing rotation braking control and pressure equalization control in Embodiment 1.

FIG. 6 is a schematic diagram for describing the rotation braking control and the pressure equalization control in Embodiment 1. In FIG. 6, the vertical axis of the graph represents specified operation frequency from the inverter 5, and the horizontal axis of the graph represents time. FIG. 6 illustrates the state of rotation braking control and the state of the flow control valve 21 corresponding to time indicated in the graph.

Assume that, at a time $T_0$, the compressor 1 is operating at an operation frequency $F_2$. At a time $T_1$, when the controller 6 receives a command to stop the compressor 1 from the outside, the drive control unit 62 performs stop control on the compressor 1. The drive control unit 62 issues, to the inverter 5, a command to reduce the operation frequency of the compressor 1 from $F_2$ to a frequency $F_1$, which is lower than $F_2$. The inverter 5 reduces the operation frequency of the compressor 1 from $F_2$ to $F_1$ on the basis of the command from the drive control unit 62.

Next, at a time T2, when the operation frequency becomes $F_1$, the controller 6 performs the rotation braking control. The drive control unit 62 issues, to the inverter 5, a command to apply a preset direct-current voltage to the stator 10*a*. The inverter 5 applies the direct-current voltage to the stator 10*a*. As a result, torque is produced at the motor 10, and the rotation braking control is performed, in which rotation of the motor rotor 10*b* is prevented or suppressed even when a force that tries to rotate the motor rotor 10*b* is received.

When the rotation braking control is performed, the controller 6 performs the pressure equalization control at the same time. The drive control unit 62 performs control such that the flow control valve 21 of the compressor 1 opens. As a result, refrigerant in the high pressure unit 16 of the compressor 1 flows into the low pressure unit 15 through the communication flow path 20, and the pressure difference between the high pressure unit 16 and the low pressure unit 15 decreases, which leads to equalization of pressure in the high pressure unit 16 and the low pressure unit 15.

At a time $T_3$, after the set rotation braking time period has elapsed, the controller 6 ends the rotation braking control. The set pressure equalization time period has also elapsed at the same time, and thus the drive control unit 62 performs control such that the flow control valve 21 of the compressor 1 closes. As a result, the pressure equalization control ends.

In this manner, the rotation braking control is performed only during the set rotation braking time period stored in the memory unit 63. The pressure equalization control is performed only during the set pressure equalization time period stored in the memory unit 63. In this case, the set rotation braking time period is set to be included in the set pressure equalization time period. Thus, the pressure equalization control is performed during a time period that includes the time period during which the rotation braking control is performed.

In particular, in Embodiment 1, the set rotation braking time period and the set pressure equalization time period are set to have the same time period. That is, in Embodiment 1, the pressure equalization control is started at the same time as when the rotation braking control is started, and the pressure equalization control ends at the same time as when the rotation braking control ends.

Figure 7:
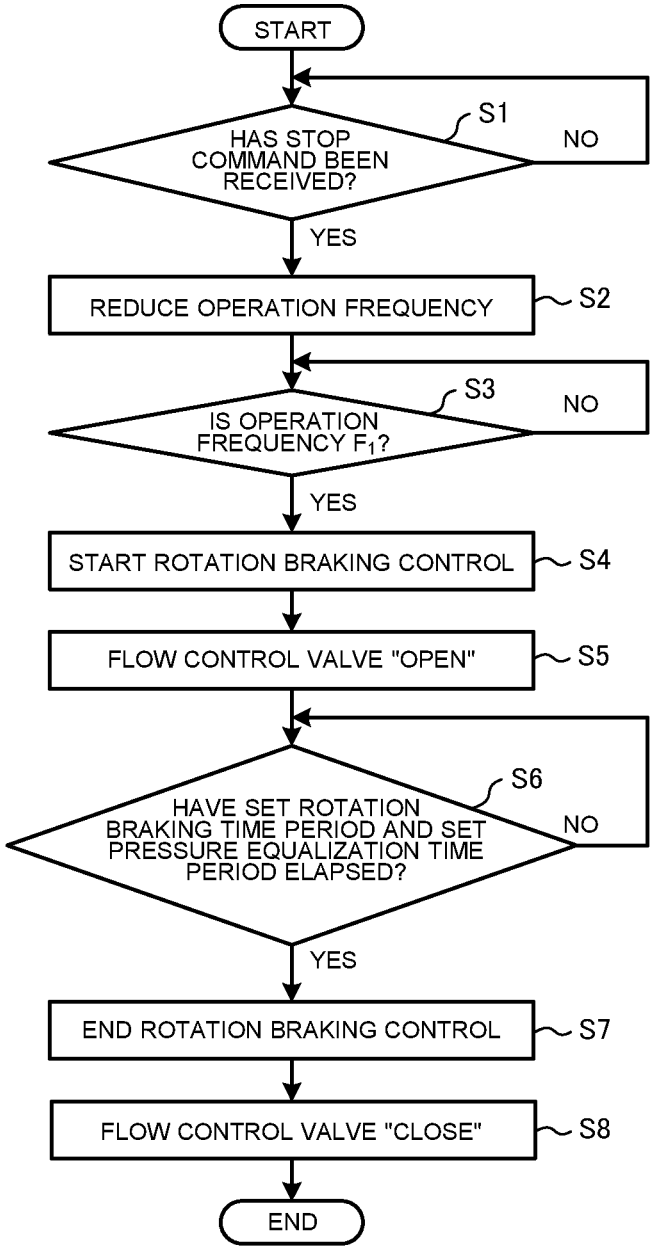
FIG. 7 is a flow chart illustrating an example of the procedure of processing performed in the rotation braking control and the pressure equalization control in Embodiment 1.

FIG. 7 is a flow chart illustrating an example of the procedure of processing performed in the rotation braking control and the pressure equalization control in Embodiment 1. First, in step S1, the controller 6 determines whether a command to stop the compressor 1 has been received from the outside. In a case where the command to stop the compressor 1 has been received (step S1: Yes), the process proceeds to step S2. In contrast, in a case where the stop command has not been received (step S1: No), the process returns to step S1, and processing in step S1 is repeated until the stop command is received.

In step S2, the drive control unit 62 controls the inverter 5 such that the operation frequency of the compressor 1 is reduced. Next, in step S3, the comparison determination unit 61 determines whether the operation frequency of the compressor 1 is $F_1$.

In a case where the operation frequency of the compressor 1 is $F_1$ (step S3: Yes), in step S4, the controller 6 starts the rotation braking control. In step S5, the drive control unit 62 performs control such that the flow control valve 21 opens. In contrast, in a case where the operation frequency of the compressor 1 is not $F_1$ (step S3: No), the process returns to step S3, and processing in step S3 is repeated until the operation frequency becomes $F_1$.

In step S6, the comparison determination unit 61 determines whether the set rotation braking time period and the set pressure equalization time period have elapsed from the start of the rotation braking control and the pressure equalization control. In a case where it is determined that the set rotation braking time period and the set pressure equalization time period have elapsed (step S6: Yes), in step S7, the controller 6 ends the rotation braking control. In step S8, the controller 6 performs control such that the flow control valve 21 closes, and ends the pressure equalization control. In contrast, in a case where it is determined that the set rotation braking time period and the set pressure equalization time period have not elapsed (step S6: No), the process returns to step S6, and the rotation braking control and the pressure equalization control are continued until the set rotation braking time period and the set pressure equalization time period elapse.

As described above, in the freezing device 100 according to Embodiment 1, when the operation of the compressor 1 stops, the rotation braking control is performed by controlling the inverter 5, and the pressure equalization control is also performed by opening the flow control valve 21 to equalize the pressure in the high pressure unit 16 and the pressure in the low pressure unit 15. In particular, in Embodiment 1, the pressure equalization control is performed during the same time period as the time period during which the rotation braking control is performed. As a result, during the rotation braking control, the flow control valve 21 opens and refrigerant flows from the high pressure unit 16 to the low pressure unit 15, so that the pressure in the high pressure unit 16 is equalized with the pressure in the low pressure unit 15. Thus, a pressure equalization time period for the high pressure unit 16 and the low pressure unit 15 can be reduced.

Since the pressure equalization time period is reduced, counter rotation of the screw rotor 12 can be prevented or suppressed after the rotation braking control ends. Thus, damage to or wearing away of the gate rotors 13 can be suppressed. Furthermore, since the pressure equalization time period is reduced, the outflow of an excessive amount of oil from the high pressure unit 16 to the low pressure unit 15 through the oil feed hole is suppressed. Thus, when the compressor 1 is started up next time, for example, a failure of the gate rotors 13 due to liquid compression (oil compression) can be prevented.

In the freezing device 100, in a case where the controller 6 controls the inverter 5 and the operation frequency of the compressor 1 has become the frequency $F_1$, which is lower than the frequency $F_2$ used during operation, the controller 6 performs the rotation braking control. As a result, the compressor 1 can be prevented from being damaged or the like due to a change in the state of the compressor 1 from an operation state to a sudden stop state.

In the freezing device 100, the communication flow path 20 may be provided outside the casing 1*a* of the compressor 1 or inside the casing 1*a*.

Embodiment 2

Next, Embodiment 2 will be described. Embodiment 2 differs from Embodiment 1 in that the pressure equalization control is continued even after the rotation braking control ends. Note that, in Embodiment 2, items the same as those of Embodiment 1 are denoted by the same reference numerals, and detailed description of the items will be omitted.

In Embodiment 2, the pressure equalization control is performed at the same time as when the rotation braking control is performed, however, the pressure equalization control is continued even after the rotation braking control ends. That is, in Embodiment 2, the set pressure equalization time period is set to be longer than the set rotation braking time period.

[Rotation Braking Control and Pressure Equalization Control]

Figure 8:
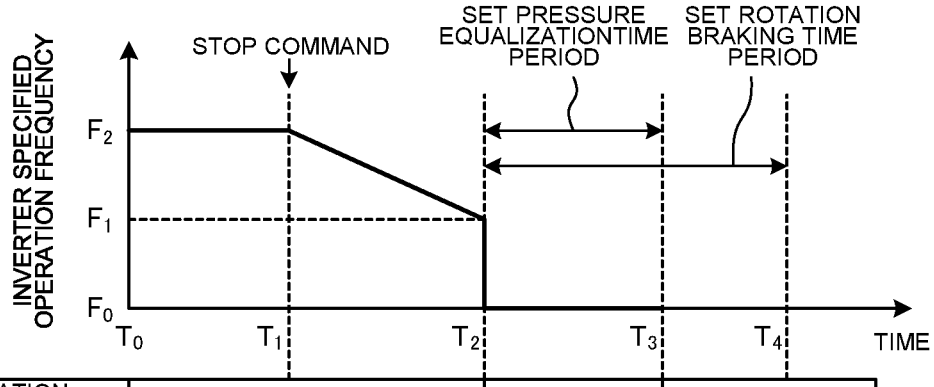
FIG. 8 is a schematic diagram for describing rotation braking control and pressure equalization control in Embodiment 2.

FIG. 8 is a schematic diagram for describing the rotation braking control and the pressure equalization control in Embodiment 2. In FIG. 8, the vertical axis of the graph represents specified operation frequency from the inverter 5, and the horizontal axis of the graph represents time. FIG. 8 illustrates the state of rotation braking control and the state of the flow control valve 21 corresponding to time indicated in the graph.

Assume that, at a time $T_0$, the compressor 1 is operating at the operation frequency $F_2$. At a time $T_1$, when the controller 6 receives a command to stop the compressor 1 from the outside, the drive control unit 62 performs stop control on the compressor 1. The drive control unit 62 issues, to the inverter 5, a command to reduce the operation frequency of the compressor 1 from $F_2$ to $F_1$. The inverter 5 reduces the operation frequency of the compressor 1 from $F_2$ to $F_1$ on the basis of the command from the drive control unit 62.

Next, at a time T2, when the operation frequency becomes $F_1$, the controller 6 performs the rotation braking control. The drive control unit 62 issues, to the inverter 5, a command to apply the preset direct-current voltage to the stator 10*a*. As a result, the rotation braking control is performed. When the rotation braking control is performed, the controller 6 performs the pressure equalization control. The drive control unit 62 performs control such that the flow control valve 21 of the compressor 1 opens.

At a time $T_3$, after the set rotation braking time period has elapsed, the controller 6 ends the rotation braking control. In contrast, since the set pressure equalization time period is longer than the set rotation braking time period, the flow control valve 21 of the compressor 1 remains in an open state, and the pressure equalization control is continued.

At a time T4, after the set pressure equalization time period has elapsed, the drive control unit 62 performs control such that the flow control valve 21 of the compressor 1 closes. As a result, the pressure equalization control ends.

In this manner, in Embodiment 2, the set pressure equalization time period is set to be longer than the set rotation braking time period. That is, in Embodiment 2, since the pressure equalization control is performed at the same time as when the rotation braking control is performed, the pressure equalization control is continued even after the rotation braking control ends.

Figure 9:
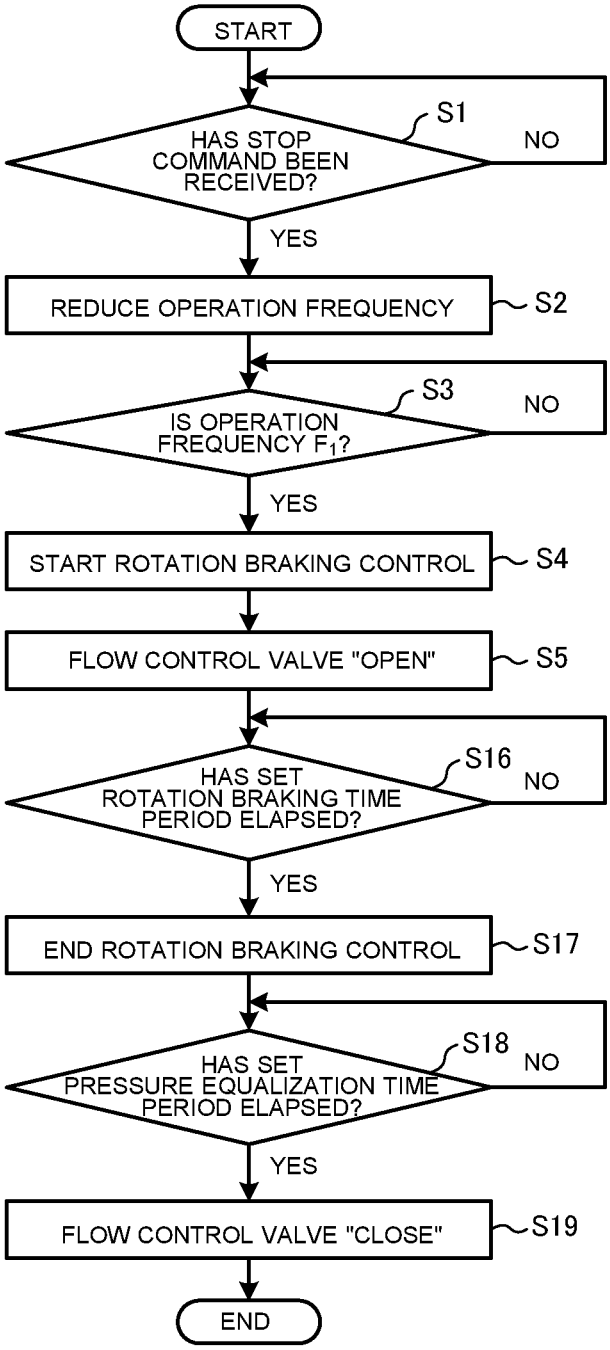
FIG. 9 is a flow chart illustrating an example of the procedure of processing performed in the rotation braking control and the pressure equalization control in Embodiment 2.

FIG. 9 is a flow chart illustrating an example of the procedure of processing performed in the rotation braking control and the pressure equalization control in Embodiment 2. Processing in steps S1 to S5 is the same as that of Embodiment 1, and thus description will be omitted.

In step S16, the comparison determination unit 61 determines whether the set rotation braking time period has elapsed from the start of the rotation braking control. In a case where it is determined that the set rotation braking time period has elapsed (step S16: Yes), in step S17, the controller 6 ends the rotation braking control. In contrast, in a case where it is determined that the set rotation braking time period has not elapsed (step S16: No), the process returns to step S16, and the rotation braking control is continued until the set rotation braking time period elapses.

In step S18, the comparison determination unit 61 determines whether the set pressure equalization time period has elapsed from the start of the pressure equalization control. In a case where it is determined that the set pressure equalization time period has elapsed (step S18: Yes), in step S19, the controller 6 ends the pressure equalization control. In contrast, in a case where it is determined that the set pressure equalization time period has not elapsed (step S18: No), the process returns to step S18, and the pressure equalization control is continued until the set pressure equalization time period elapses.

As described above, in the freezing device 100 according to Embodiment 2, the pressure equalization control is continued even after the rotation braking control ends. As a result, even in a case where the pressure in the high pressure unit 16 and the pressure in the low pressure unit 15 cannot be sufficiently equalized with each other after the rotation braking control ends, pressure equalization is continued. Thus, the pressure equalization time period can be further reduced.

Embodiment 3

Next, Embodiment 3 will be described. Embodiment 3 differs from Embodiment 1 in that the pressure equalization control is started before the rotation braking control is started. Note that, in Embodiment 3, items the same as those of Embodiments 1 and 2 are denoted by the same reference numerals, and detailed description will be omitted.

In Embodiment 3, the pressure equalization control is started before the rotation braking control is started, and the pressure equalization control ends at the same time as when the rotation braking control ends. That is, in Embodiment 3, the set pressure equalization time period is set to be longer than the set rotation braking time period. In Embodiment 3, a set pressure equalization start time indicating a time at which the pressure equalization control is to be started is set in advance, and this set pressure equalization start time is set to be a time before the start of the rotation braking control.

The set pressure equalization start time is stored in advance in the memory unit 63 of the controller 6. The set pressure equalization start time is set to be a freely selected time as long as the time is before the start of the rotation braking control. Note that the set pressure equalization start time may be a timing before a command to stop the compressor 1 is received or a timing after the stop command is received.

[Rotation Braking Control and Pressure Equalization Control]

Figure 10:
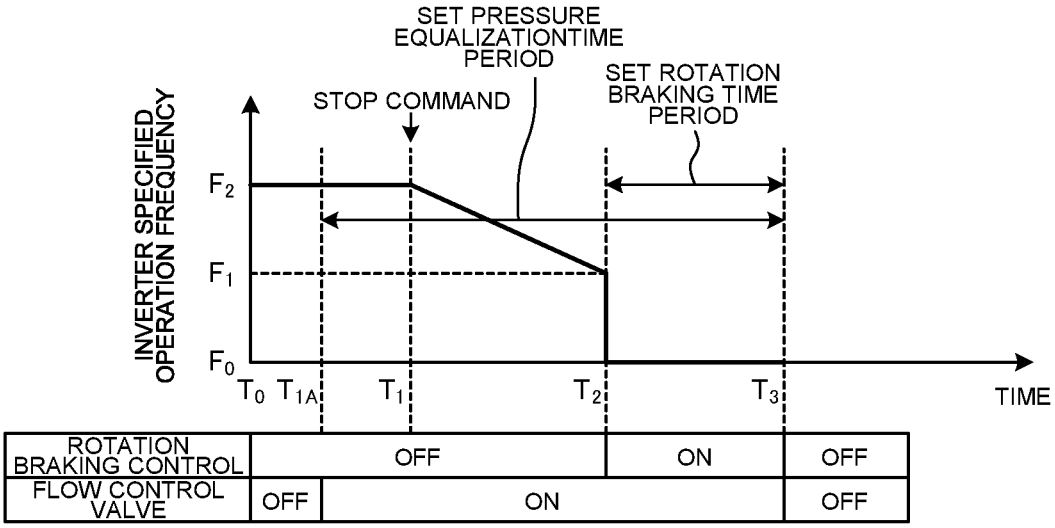
FIG. 10 is a schematic diagram for describing rotation braking control and pressure equalization control in Embodiment 3.

FIG. 10 is a schematic diagram for describing the rotation braking control and the pressure equalization control in Embodiment 3. In FIG. 10, the vertical axis of the graph represents specified operation frequency from the inverter 5, and the horizontal axis of the graph represents time. FIG. 10 illustrates the state of rotation braking control and the state of the flow control valve 21 corresponding to time indicated in the graph. Furthermore, the example in FIG. 10 illustrates a case where the set pressure equalization start time is set to be a timing before a command to stop the compressor 1 is received.

Assume that, at a time $T_0$, the compressor 1 is operating at the operation frequency $F_2$. At a time $T_{1A}$, when the set pressure equalization start time arrives, the controller 6 performs the pressure equalization control. The drive control unit 62 performs control such that the flow control valve 21 of the compressor 1 opens.

At a time $T_1$, when the controller 6 receives a command to stop the compressor 1 from the outside, the drive control unit 62 performs stop control on the compressor 1. The drive control unit 62 issues, to the inverter 5, a command to reduce the operation frequency of the compressor 1 from $F_2$ to $F_1$. The inverter 5 reduces the operation frequency of the compressor 1 from $F_2$ to $F_1$ on the basis of the command from the drive control unit 62.

Next, at a time T2, when the operation frequency becomes $F_1$, the controller 6 performs the rotation braking control. The drive control unit 62 issues, to the inverter 5, a command to apply the preset direct-current voltage to the stator 10*a*. As a result, the rotation braking control is performed.

At a time $T_3$, after the set rotation braking time period has elapsed, the controller 6 ends the rotation braking control. The set pressure equalization time period has also elapsed at the same time, and thus the drive control unit 62 performs control such that the flow control valve 21 of the compressor 1 closes. As a result, the pressure equalization control ends.

In this manner, in Embodiment 3, the set pressure equalization time period is set to be longer than the set rotation braking time period. The set pressure equalization start time is set to be a time before the start of the rotation braking control. That is, in Embodiment 3, the pressure equalization control is started before the rotation braking control is started.

Figure 11:
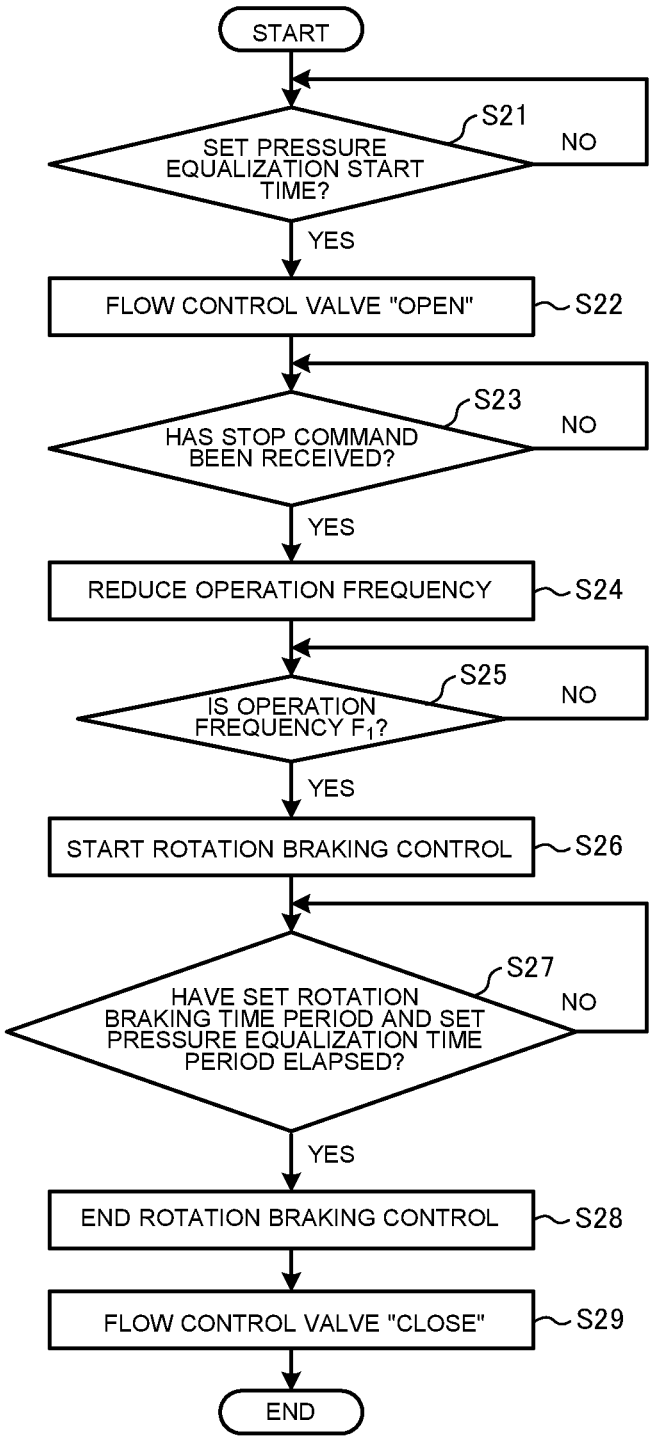
FIG. 11 is a flow chart illustrating an example of the procedure of processing performed in the rotation braking control and the pressure equalization control in Embodiment 3.

FIG. 11 is a flow chart illustrating an example of the procedure of processing performed in the rotation braking control and the pressure equalization control in Embodiment 3. Note that the example in FIG. 11 illustrates a case where the set pressure equalization start time is set to be a timing before a command to stop the compressor 1 is received.

First, in step S21, the comparison determination unit 61 determines whether the set pressure equalization start time stored in the memory unit 63 has arrived. In a case where the set pressure equalization start time has arrived (step S21: Yes), in step S22, the drive control unit 62 performs control such that the flow control valve 21 opens. In contrast, in a case where the set pressure equalization start time has not arrived (step S21: No), the process returns to step S21, and processing in step S21 is repeated until the set pressure equalization start time arrives.

In step S23, the controller 6 determines whether a command to stop the compressor 1 has been received from the outside. In a case where the command to stop the compressor 1 has been received (step S23: Yes), in step S24, the drive control unit 62 controls the inverter 5 such that the operation frequency of the compressor 1 is reduced. In contrast, in a case where the stop command has not been received (step S23: No), the process returns to step S23, and processing in step S23 is repeated until the stop command is received.

Next, in step S25, the comparison determination unit 61 determines whether the operation frequency of the compressor 1 is $F_1$. In a case where the operation frequency of the compressor 1 is $F_1$ (step S25: Yes), in step S26, the controller 6 starts the rotation braking control. In contrast, in a case where the operation frequency of the compressor 1 is not $F_1$ (step S25: No), the process returns to step S25, and processing in step S25 is repeated until the operation frequency becomes $F_1$.

In step S27, the comparison determination unit 61 determines whether the set rotation braking time period and the set pressure equalization time period have elapsed from the start of the rotation braking control and the pressure equalization control, respectively. In a case where it is determined that the set rotation braking time period and the set pressure equalization time period have elapsed (step S27: Yes), in step S28, the controller 6 ends the rotation braking control. In step S29, the controller 6 performs control such that the flow control valve 21 closes, and ends the pressure equalization control. In contrast, in a case where it is determined that the set rotation braking time period and the set pressure equalization time period have not elapsed (step S27: No), the process returns to step S27, and the rotation braking control and the pressure equalization control are continued until the set rotation braking time period and the set pressure equalization time period elapse.

As described above, in the freezing device 100 according to Embodiment 3, the pressure equalization control is started before the rotation braking control is started. As a result, when the rotation braking control ends, the pressure difference between the high pressure unit 16 and the low pressure unit 15 becomes small. Thus, the pressure equalization time period required for the high pressure unit 16 and the low pressure unit 15 can be further reduced.

Since the pressure difference between the high pressure unit 16 and the low pressure unit 15 is made smaller when the rotation braking control is started, the counter rotation force of the screw rotor 12 is suppressed. As a result, the amount of direct current flowing from the inverter 5 to the stator 10*a* when the rotation braking control is performed can be made smaller. The flow of an excessive amount of current to the inverter 5 can thus be suppressed, so that it becomes possible for the inverter 5 to be less likely to fail.

Embodiment 4

Next, Embodiment 4 will be described. Embodiment 4 is a combination of Embodiments 2 and 3. That is, in Embodiment 4, the pressure equalization control is started before the rotation braking control is started, and the pressure equalization control is continued even after the rotation braking control ends. Note that, in Embodiment 4, items the same as those of Embodiments 1 to 3 are denoted by the same reference numerals, and detailed description will be omitted.

In Embodiment 4, the pressure equalization control is started before the rotation braking control is started, and the pressure equalization control is continued even after the rotation braking control ends. That is, in Embodiment 4, the set pressure equalization time period is set to be longer than the set rotation braking time period. The set pressure equalization start time is set to be a time before the start of the rotation braking control. Note that, similarly to as in Embodiment 3, the set pressure equalization start time and a command to stop the compressor 1 do not need to have a specific relationship.

[Rotation Braking Control and Pressure Equalization Control]

Figure 12:
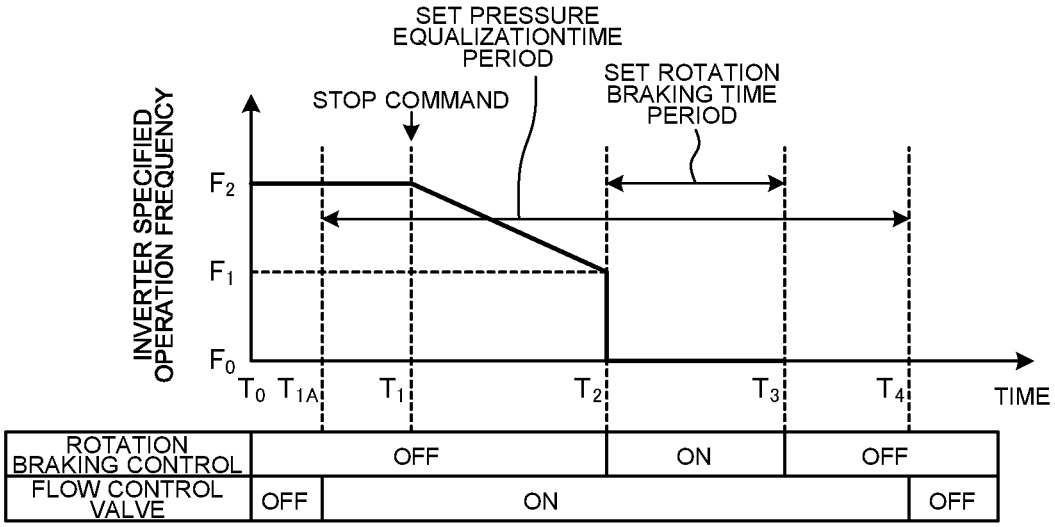
FIG. 12 is a schematic diagram for describing rotation braking control and pressure equalization control in Embodiment 4.

FIG. 12 is a schematic diagram for describing the rotation braking control and the pressure equalization control in Embodiment 4. In FIG. 12, the vertical axis of the graph represents specified operation frequency from the inverter 5, and the horizontal axis of the graph represents time. FIG. 12 illustrates the state of rotation braking control and the state of the flow control valve 21 corresponding to time indicated in the graph.

Assume that, at a time $T_0$, the compressor 1 is operating at the operation frequency $F_2$. At a time $T_{1A}$, when the set pressure equalization start time arrives, the controller 6 performs the pressure equalization control. The drive control unit 62 performs control such that the flow control valve 21 of the compressor 1 opens.

At a time $T_1$, when the controller 6 receives the command to stop the compressor 1 from the outside, the drive control unit 62 performs stop control on the compressor 1. The drive control unit 62 issues, to the inverter 5, a command to reduce the operation frequency of the compressor 1 from $F_2$ to $F_1$. The inverter 5 reduces the operation frequency of the compressor 1 from $F_2$ to $F_1$ on the basis of the command from the drive control unit 62.

Next, at a time T2, when the operation frequency becomes $F_1$, the controller 6 performs the rotation braking control. The drive control unit 62 issues, to the inverter 5, a command to apply the preset direct-current voltage to the stator 10*a*. As a result, the rotation braking control is performed.

At a time $T_3$, after the set rotation braking time period has elapsed, the controller 6 ends the rotation braking control. In contrast, since the set pressure equalization time period is longer than the set rotation braking time period, the flow control valve 21 of the compressor 1 remains in the open state, and the pressure equalization control is continued.

At a time T4, after the set pressure equalization time period has elapsed, the drive control unit 62 performs control such that the flow control valve 21 of the compressor 1 closes. As a result, the pressure equalization control ends.

In this manner, in Embodiment 4, the set pressure equalization time period is set to be longer than the set rotation braking time period. The set pressure equalization start time is set to be a time before the start of the rotation braking control. That is, in Embodiment 4, the pressure equalization control is started before the rotation braking control is started, and the pressure equalization control is continued even after the rotation braking control ends.

Figure 13:
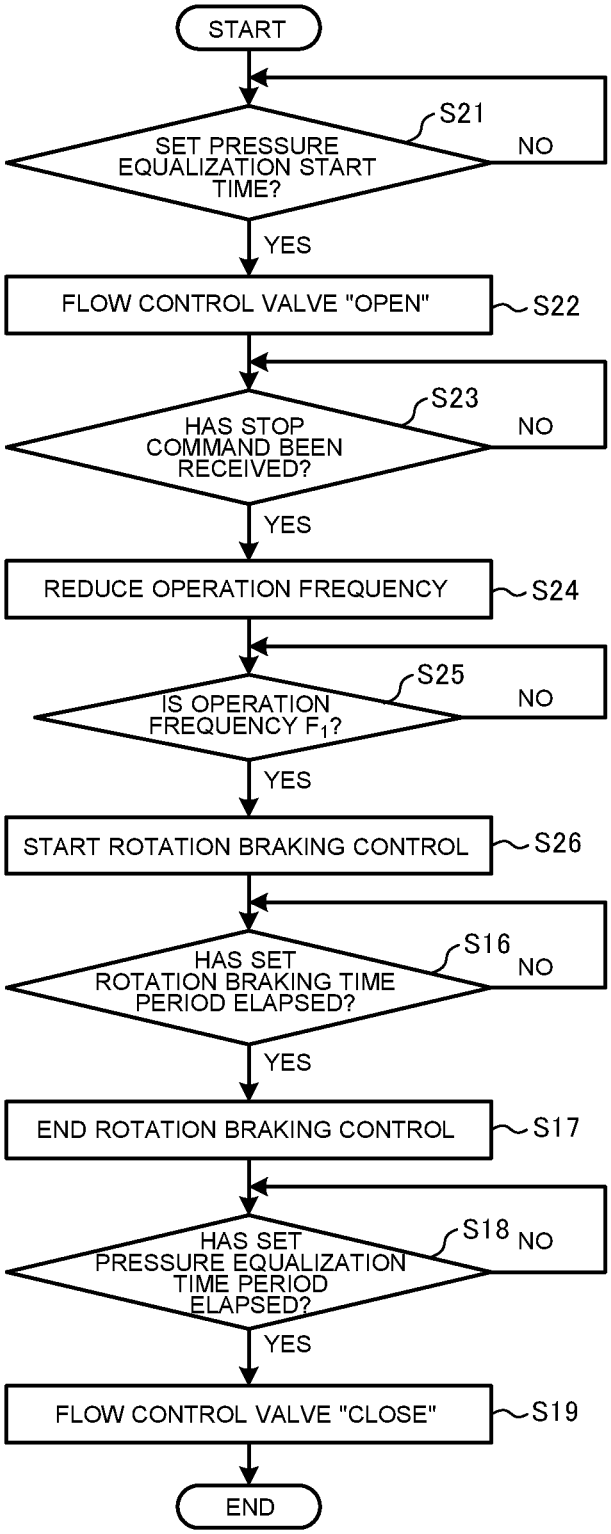
FIG. 13 is a flow chart illustrating an example of the procedure of processing performed in the rotation braking control and the pressure equalization control in Embodiment 4.

FIG. 13 is a flow chart illustrating an example of the procedure of processing performed in the rotation braking control and the pressure equalization control in Embodiment 4. Note that the example in FIG. 13 illustrates a case where the set pressure equalization start time is set to be a timing before a command to stop the compressor 1 is received.

In Embodiment 4, similarly to as in Embodiment 3, the pressure equalization control and the rotation braking control are started by performing processing in steps S21 to S26 illustrated in FIG. 11.

Thereafter, similarly to as in Embodiment 2, the rotation braking control and the pressure equalization control are ended by performing processing in steps S16 to S19 illustrated in FIG. 9.

As described above, in the freezing device 100 according to Embodiment 4, the pressure equalization control is started before the rotation braking control is started, and the pressure equalization control is continued even after the rotation braking control ends.

As a result, similarly to as in Embodiments 2 and 3, the pressure equalization time period required for the high pressure unit 16 and the low pressure unit 15 can be further reduced, and also it becomes possible for the inverter 5 to be less likely to fail.

Embodiments 1 to 4 of the freezing devices 100 have been described above; however, the freezing devices 100 are not limited to those of Embodiments 1 to 4 described above, and various modifications and applications can be made without departing from the gist of the present disclosure. For example, in Embodiments 1 to 4, cases where a single screw compressor is used as the compressor 1 have been described; however, the cases are not limited to this example. As the compressor 1, for example, a twin screw compressor, which has two screw rotors and in which compression spaces are formed by engaging the channel units of the screw rotors, may be applied. Alternatively, as the compressor 1, for example, a reciprocating compressor, a scroll compressor, a turbocompressor, and a rotary compressor may also be applied.

In Embodiments 1 to 4, the inverter 5 is described as being formed as a unit separate from the compressor 1; however, the inverter 5 is not limited to this. For example, the inverter 5 may also be integrally formed with the compressor 1.

REFERENCE SIGNS LIST

1: compressor, 1*a*: casing, 1*b*: partition wall, 1*c*: discharge port, 2: condenser, 3: pressure reducing device, 4: evaporator, 5: inverter, 6: controller, 10: motor, 10*a*: stator, 10*b*: motor rotor, 11: screw shaft, 11*a*: main bearing, 11*b*: sub-bearing, 12: screw rotor, 12*a*: screw channel, 13: gate rotor, 13*a*: tooth, 14: compression space, 15: low pressure unit, 16: high pressure unit, 17: strainer, 18: check valve, 20: communication flow path, 21: flow control valve, 61: comparison determination unit, 62: drive control unit, 63: memory unit, 71: processing circuit, 81: processor, 82: memory, 100: freezing device.

The invention claimed is:

1. A freezing device including a compressor that compresses sucked refrigerant using a compression mechanism and discharges compressed refrigerant, the freezing device comprising:

a compressor including a motor that drives the compression mechanism, a low pressure unit in which the sucked refrigerant flows, a compression space in which the refrigerant flowing in the low pressure unit is compressed, a high pressure unit in which the refrigerant compressed in the compression space flows, a communication flow path through which the low pressure unit and the high pressure unit communicate, and a flow control valve that is provided in the communication flow path and that controls a flow rate of the refrigerant flowing through the communication flow path;

an inverter that supplies a voltage to the compressor and drives or stops the motor; and a controller configured to control the inverter and the flow control valve, wherein the controller performs in stop control in which an operation of the compressor is stopped, braking control in which driving of the compression mechanism is prevented or suppressed by controlling the inverter, and pressure equalization control in which pressure in the high pressure unit is equalized with pressure in the low pressure unit by opening the flow control valve.

2. The freezing device of claim 1, wherein the compression mechanism is a rotor of the motor, and the controller controls the inverter to prevent or suppress counter rotation of the rotor in a case where the controller performs the braking control.

3. The freezing device of claim 1, wherein the controller performs the pressure equalization control during a same time period as a time period during which the braking control is performed.

4. The freezing device of claim 1, wherein the controller continues the pressure equalization control even after the braking control ends.

5. The freezing device of claim 1, wherein the controller starts the pressure equalization control before starting the braking control.

6. The freezing device of claim 5, wherein the controller starts the pressure equalization control before the start of the braking control, and starts the braking control after receiving a command to stop the compressor from an outside.

7. The freezing device of claim 1, wherein in a case where an operation frequency of the compressor reaches a set frequency lower than a frequency used during operation, the controller performs the braking control by the inverter.

8. The freezing device of claim 1, wherein the controller performs the braking control by controlling the inverter to reduce an operation frequency of the compressor.

9. The freezing device of claim 1, wherein the communication flow path is provided outside the compressor.

10. The freezing device of claim 1, wherein the communication flow path is provided inside the compressor.

11. The freezing device of claim 1, wherein the compressor includes a casing, and that the low pressure unit, the compression space, and the high pressure unit are all formed in the casing.

* * * * *